US005163851A

United States Patent [19]

Hart et al.

[11] Patent Number: 5,163,851

[45] Date of Patent: Nov. 17, 1992

[54] CONNECTOR WITH FORMED WIRE BOARDLOCK AND BOARDLOCK THEREFOR

[75] Inventors: Gerald J. Hart, Mechanicsburg; Stephen B. Schieferly, Saylorsburg, both of Pa.

[73] Assignee: AMP Incorporated, Harrisburg, Pa.

[21] Appl. No.: 862,675

[22] Filed: Apr. 3, 1992

[51] Int. Cl.[5] ..... H01R 13/73

[52] U.S. Cl. ..... 439/567; 439/607

[58] Field of Search ..... 439/567, 571, 557, 554, 439/558, 82, 825, 607

[56] References Cited

U.S. PATENT DOCUMENTS

| | | | |
|---|---|---|---|
| 4,512,618 | 4/1985 | Kumar . | |
| 4,717,219 | 1/1988 | Frantz et al. | 439/82 |
| 4,721,473 | 1/1988 | DelGuidice et al. | 438/79 |
| 4,842,552 | 6/1989 | Frantz | 439/557 |
| 4,889,502 | 12/1989 | Althouse et al. | 439/554 |
| 4,943,244 | 7/1990 | Teck et al. | 439/567 |
| 5,080,611 | 1/1992 | Hypes | 439/567 |
| 5,104,339 | 4/1992 | Verhoeven | 439/567 |

*Primary Examiner*—Gary F. Paumen
*Attorney, Agent, or Firm*—David L. Smith

[57] ABSTRACT

An electrical connector (20) is disclosed which includes a dielectric housing (24) having contacts (26) secured therein. The housing has a mounting flange (48) which defines a mounting face (46), a top face (52) and an aperture (54) extending therebetween. The aperture defines aat least one wall. The top face has a transverse channel (62) proximate the aperture, with the wall having a channel (60) that intersects the transverse channel (62). The two channels are substantially perpendicular to each other. A wire formed boardlock (22) is disposed in the aperture (54). The boardlock has a first portion within the aperture and a second portion extending beyond the mounting face for reception in a boardlock receiving hole in a circuit board. The first portion of the boardlock includes a retention portion receivable in the transverse channel (62), and an alignment portion receivable in the channel (60) in the wall.

8 Claims, 5 Drawing Sheets

CONNECTOR WITH FORMED WIRE BOARDLOCK AND BOARDLOCK THEREFOR

BACKGROUND OF THE INVENTION

This invention relates to securing electrical connectors to a circuit board and in particular to a boardlock for temporarily securing a connector to a circuit board prior to soldering.

Electrical connectors are often secured to a circuit board during a board stuffing operation by a boardlock that temporarily holds the connector is the desired position until more permanently secured in a soldering process. In the soldering process, the contact of surface mount connectors are soldered to land on the circuit board whereas the contacts of through hole mount connectors are soldered in plated through holes. These solder connections more permanently secured the connector in position on the circuit board, with the board lock, when soldered, also contributing to the more permanent retention of the connector on the board. In addition to providing retention on a board, a board lock may provide a secondary function of an electrical path to a ground on the circuit board from the shell of a shielded connector.

Most prior art boardlock such as those disclosed in U.S. Pat. Nos. 4,717,219 and 4,842,552 provide a one-piece boardlock that engages a portion of the shielding shell of a connector and extends to beyond the mounting face of the connector, to be soldered to a ground on the circuit board.

SUMMARY OF THE INVENTION

In accordance with the present invention, an electrical connector is disclosed which includes a dielectric housing having contacts secured therein. The housing has a mounting flange which defines a mounting face, a top face and an aperture extending therebetween. The aperture defines at least one wall. The top wall has a transverse channel proximate the aperture, with the wall having a channel that intersects the transverse channel. The two channels are substantially perpendicular to each other. A wire formed boardlock is disposed in the aperture. The boardlock has a first portion within the aperture and a second portion extending beyond the mounting face for reception in a boardlock receiving hole in a circuit board. The first portion of the boardlock includes a retention portion receivable in the transverse channel, and an alignment portion receivable in the channel in the wall.

DESCRIPTION 0F THE PREFERRED EMBODIMENT

Figure 1:
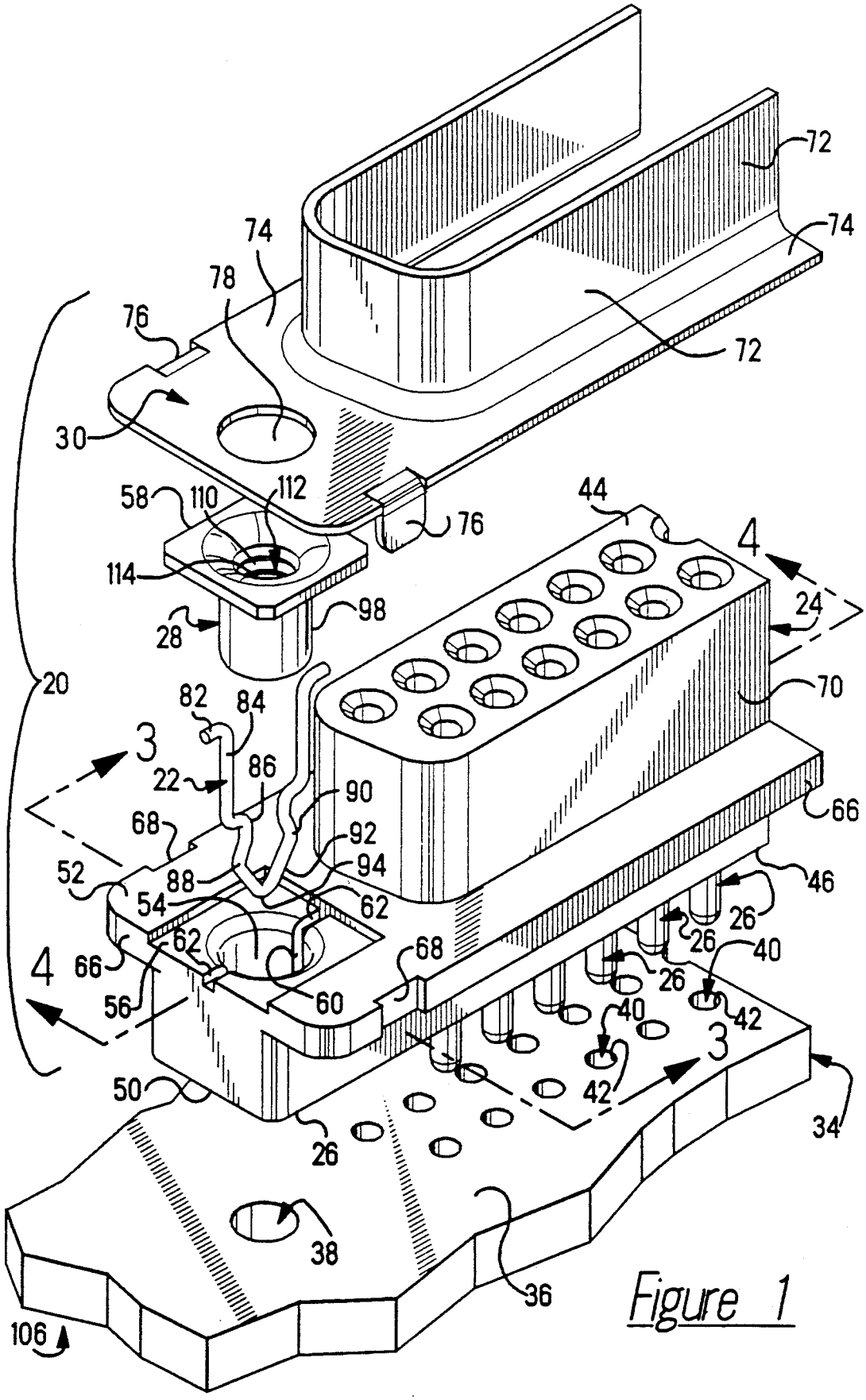
FIG. 1 is a partial exploded perspective view of an electrical connector in accordance with the present invention and a boardlock in accordance with the present invention, exploded from a circuit board.

An exploded perspective view of connector 20 having a wire formed boardlock 22 is shown in FIG. 1. Connector 20 includes a dielectric housing 24 molded of a suitable thermoplastic material, contacts 26 secured in the housing, a wire formed boardlock 22 and a drop-in insert 28. When connector 20 is shielded, connector 20 may include a shielding shell 28.

In FIG. 1, connector 20 is positioned over circuit board 34. Circuit board 34 has a mounting surface 36 for receiving connector 20. Circuit board 34 has spaced boardlock receiving apertures 38 (only one is shown in FIG. 1) for receiving wire formed boardlocks 22. The boardlock receiving apertures 38 extend through board 34 and typically are plated through holes. The board lock receiving apertures 38 are spaced to align with wire formed boardlocks 22 on connector 20. Circuit board 34 also has contact receiving apertures 40 in the formed of plated through holes for receiving solderable portions of respective contacts 26. Contact receiving apertures 40 also extend through board 34 and have metallic linings 42 to which the contacts 26 are soldered.

Housing 24 includes a mating face 44 for mating with a complimentary connector (not shown), a mounting face 46 for mounting against surface 36 of board 34, and at least one mounting flange 48 for receiving a wire formed boardlock 22. The mounting flange 48 has a bottom surface 50 coplanar with mounting face 46, an upper face 52 opposite bottom surface 50, and an aperture 54 for receiving wire formed boardlock 22 extending therebetween.

A recess 56 in face 52 accommodates the flange 58 of insert 28. Typically, the recess 56 is of less depth than the thickness of flange 58 and is of greater width than aperture 54. In the absence of drop-in insert 28, there is no need for recess 56. Recess 56 permits wire formed boardlock 22 and the drop-in insert 28 to be recessed into the housing 24. The shape of recess 56 is defined to position the drop-in insert 28 and prevent its rotation; the depth of recess 56 is to assure mechanical engagement between insert 28 and shell 30, thereby establishing electrical continuity therebetween in accordance with the teaching of U.S. Pat. No. 4,889,502 which is hereby incorporated by reference.

Figure 3:
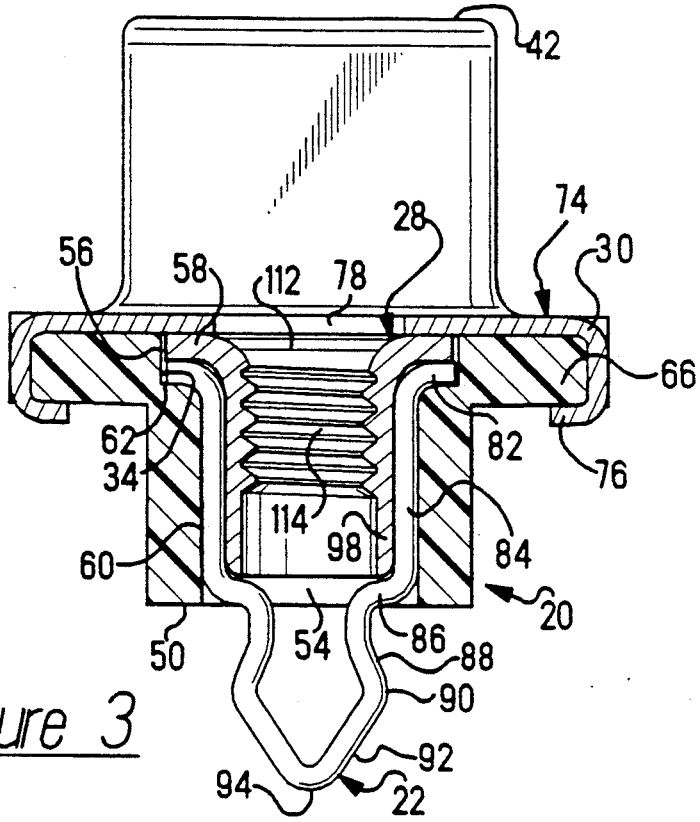
FIG. 3 is a partial sectional view of the connector and boardlock taken along line 3—3 of FIG. 1 showing the formed wire boardlock transversed to the connector housing.
Figure 4:
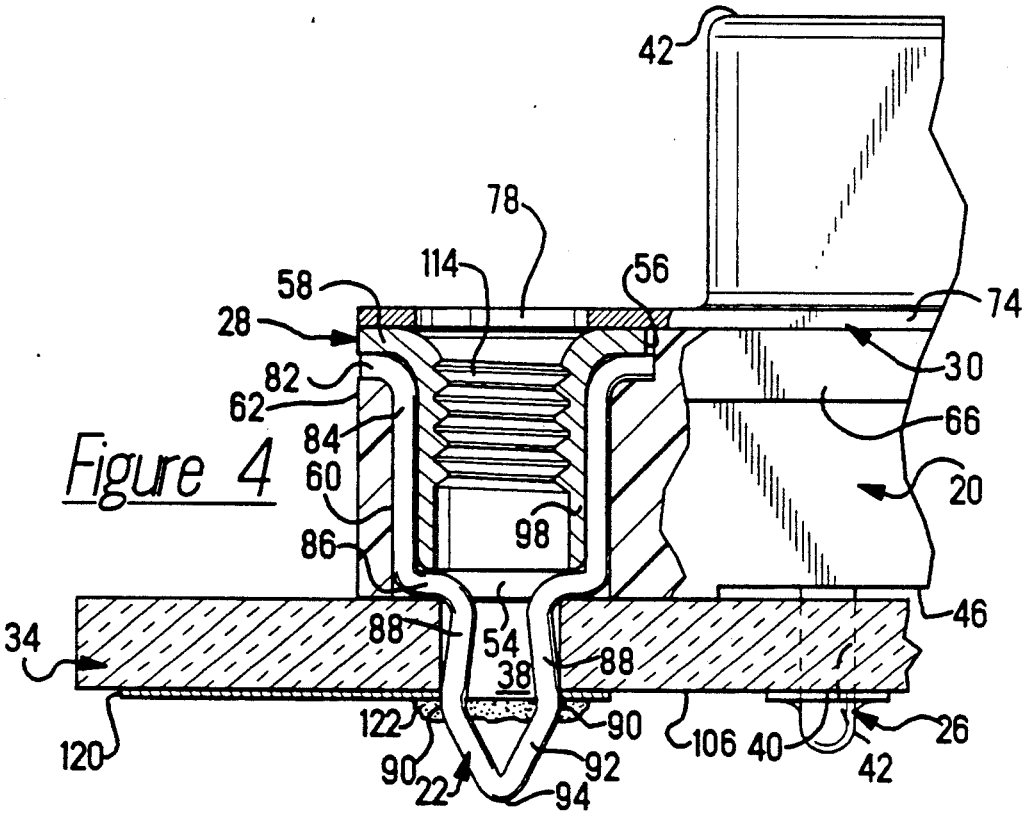
FIG. 4 is a partial sectional view of the connector of FIG. 1 assembled and mounted on a circuit board, taken along line 4—4 of FIG. 1 showing the formed wire boardlock aligned with the major axis of the connector housing.

Aperture 54 includes side slots 60 for receiving opposite side portions of wire formed boardlock 22. Contiguous with side slot 60 are transverse slots 62 extending along the base of recess 56 when present, otherwise extending along face 52, for receiving opposite ends of wire formed boardlock 22. Side slots 60 determine the position that wire formed boardlock 22 takes with respect to aperture 54 and housing 24. Wire formed board lock 22 may be positioned aligned with the major axis of housing 24 as shown in FIGS. 1 and 4 or transverse to housing 24, or the major axis thereof, as shown in FIG. 3. Transverse slots 62 permit upper portions of the wire formed boardlock 22 to be recessed into housing 24 to accommodate drop-in insert 28.

Housing 24 has a peripheral flange 66 having tab receiving recesses 68 therein on opposite major edges aligned with aperture 54. Offstanding from flange 66 toward mating face 44, the connector form shroud 70 surrounding the mating portions of contacts 26. The shroud 70 may take on a trapezoidal shape for polarization. Shielding shell 30 is receivable over housing 24 from the mating face 44 and has a shroud 72 formed to surround shroud 70. Shielding shell 30 has a flange 74 that lays over flange 66, retention tabs 76 for receipt in recesses 66 as they are folded under flange 66 and an aperture 78 between tabs 76 aligned with aperture 54.

Figure 2:
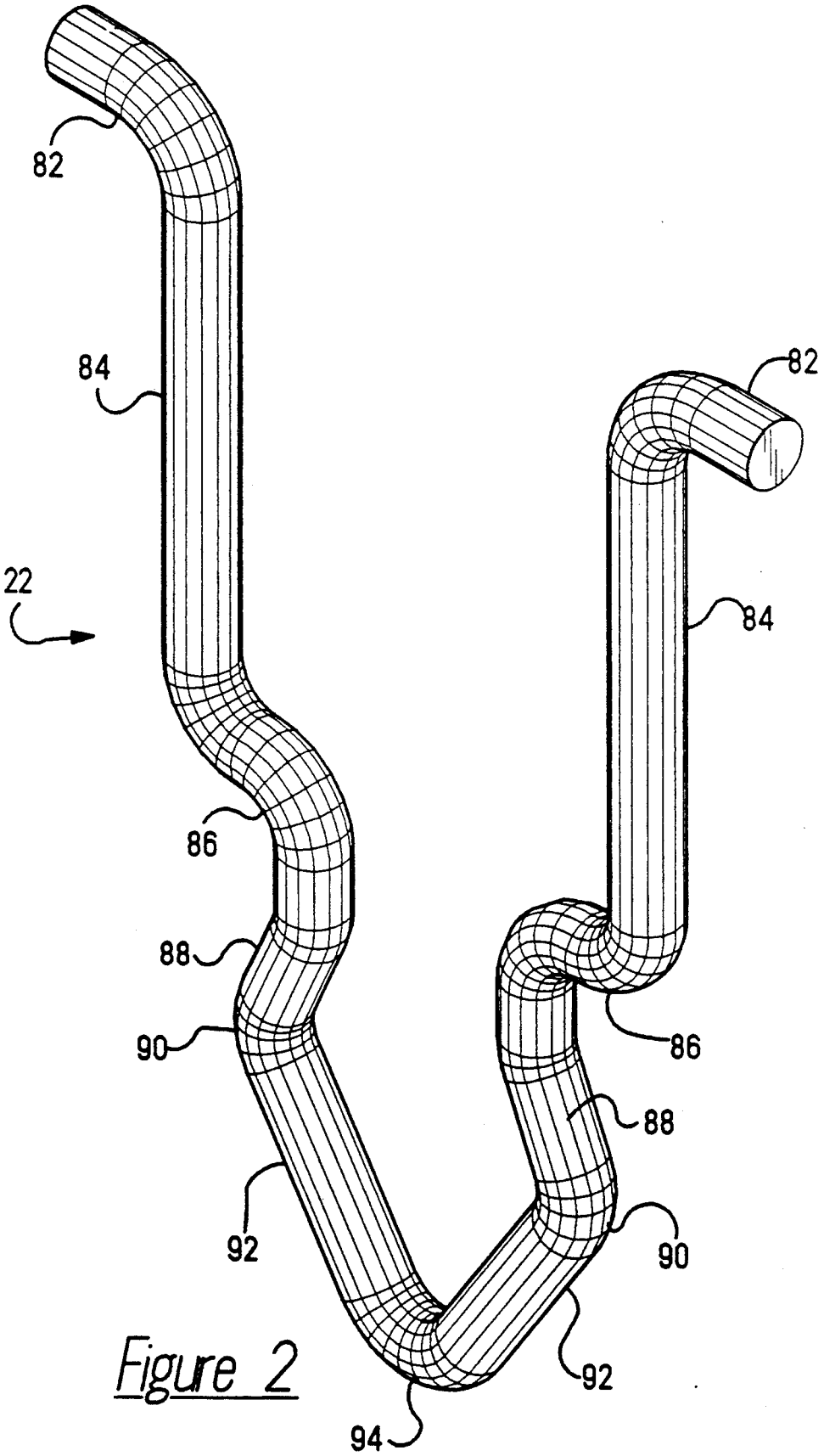
FIG. 2 is an enlarged perspective view of a formed wire boardlock.

As best seen in FIG. 2, boardlock 22 includes a retention portion 82, an orientation portion 84 an insert bottoming portion 86, diverging sections 88, apexes 90 and tapered lead-in portions 92 extending to distal end 94.

The retention portions 82 are received in respective transverse slots 62. Slots 62 are typically of less depth than the diameter or thickness of retention portions 82 such that when received in transverse slots 62, retention portions 84 extend above the floor of recess 56. Retention portions 82 restrain the connector 20 from moving away from circuit board 34 when connector 20 is mounted thereon.

The orientation portions 84 align the wire formed boardlock within side slots 60 in aperture 54. The diameter of aperture 54 is substantially the diameter shank 98 of insert 28. With orientation portions 84 received in side slots 60, shank 98 upon insertion passes between orientation portions 84. While side slots 60 in the preferred embodiment are substantially the depth of the diameter of orientation portions 84, an alternate embodiment would provide side slots 60 of less depth to provide mechanical engagement between orientation portions 84 and the shank 98 to provide electrical continuity therebetween.

The insert bottoming portions 86 extends transverse to orientation portions 84, extending inwardly toward each other, typically below the bottom 100 of shank 98. Insert bottoming portions 86 provide for a diverging portion therebelow. Insert bottoming portions could engage bottom 100 of shank 98 to assure mechanical engagement therewith and provide electrical continuity between insert 28 and wire formed boardlock 22.

Diverging sections 88 are positioned along wire formed boardlock 22 such that when boardlock 22 is received in aperture 54, diverging sections 88 extend below mounting face 46 (as seen in FIG. 3) to the range of distances where the bottom surface of 106 of a circuit board is expected to fall. In this manner, diverging sections 88 provide tolerance forgiveness for mounting connector 20 on circuit boards of varying thicknesses.

Tapered lead-in portions 92 extend (downwardly in FIG. 2) to intersect at distal end 94. Distal end 94 typically extends to a greater distance from mounting face 46 than the distal ends of the solder tail portions of contact 26. Tapered lead-in portions 92 assist in properly positioning connector 20 on board 34 once distal ends 94 are received in boardlock receiving apertures 38.

With contacts secured in housing 24, wire formed boardlock 22 is inserted, tapered lead-in portions 92 first, into aperture 54 from face 52. Insert 28 is then disposed in aperture 54 and recess 56. The flange 58 of insert 28 is received over retention portions 82 of wire formed boardlock 22.

Insert 28 is drawn and has flange 58 with a central opening 110 and a cylindrical shank 98 with axial bore 112 aligned with opening 110. Shank 98 is adapted to be disposed in aperture 54. Shank 98 typically has internal threads 114 so that a mating connector can be threadingly secured to connector 20, as disclosed in U.S. Pat. No. 4,889,502. Flange 58 is sized to be received in recess 54 and its shape is such that it cooperates with walls defining recess 54 to prevent rotation of insert 28 therein. Shank 98 fits between the tines of wire formed boardlock 22, specifically between the retention portions and orientation portions on opposite sides of aperture 54.

As wire formed boardlock 22 is positioned in aperture 54, distal end 94 extends beyond mounting face 46, orientation portions 84 are received in side slots 62 and the retention portions 82 are received in transverse slots 62, as shown in FIGS. 3 or 4.

Boardlock 22, and insert 28 when used, are secured in housing 24 when shielding shell 72 is secured to housing 24. For through hole mount solder tails, contacts 26 are aligned with the corresponding contact receiving apertures 42 in circuit board 34. As connector 20 is moved toward surface 36 of circuit board 34, the distal end of wire formed boardlock 22 is received in boardlock receiving aperture 38 and the distal ends of solder tails pass into contact receiving apertures 42. The tapered lead-in portion 92 deflect inwardly until apexes 90 pass into aperture 38. The boardlock is sized such that the apexes emerge from the bottom of board 34 and tapered lead-ins 92 as well as diverging sections 88 resile outwardly slightly. Diverging sections 88 engage the periphery of aperture 38 at the bottom surface 106 of board 34 to temporarily secure connector 20 to board 34 as shown in FIG. 4. Wire formed boardlock 22 thus provides a retentive force holding wire formed boardlock 22 and connector 20 to board 34 until more permanently secured thereto such as by solder.

Wire formed boardlock 22 also provides a ground path for interconnecting a shield of a mating connector (not shown) to a ground on circuit board 34. Shell 72 is electrically commoned with wire formed boardlock 22, either directly or indirectly through drop-in insert 28. This provides a ground path from shell 72 through board lock 22 to the ground trace 120.

The thickness of flange 58 of drop-in insert 28 is greater than the depth of recess 54 to assure mechanical contact and hence electrical continuity between shell 72 and insert 28. In the absence of insert 28, the thickness of wire formed boardlock 22, there is no need for recess 54 and transverse slots 62 would be in upper face 52 and provide for direct engagement between wire formed boardlock 22 and shell 72.

FIG. 4 shows connector 2 mounted on circuit board 34 and soldered thereto with solder fillet 122 interconnecting wire formed boardlock 22 and ground trace 120. Note that with solder being received between the tapered lead-in portions 92, the tapered lead-in portions will not move closer together to release boardlock 22 and hence connector 20 without first removing the solder fillet 122. Solder fillet 124 establishes electrical continuity between solder tails of contacts 26 and traces on the lower surface 106 of circuit board 34.

Figure 5:
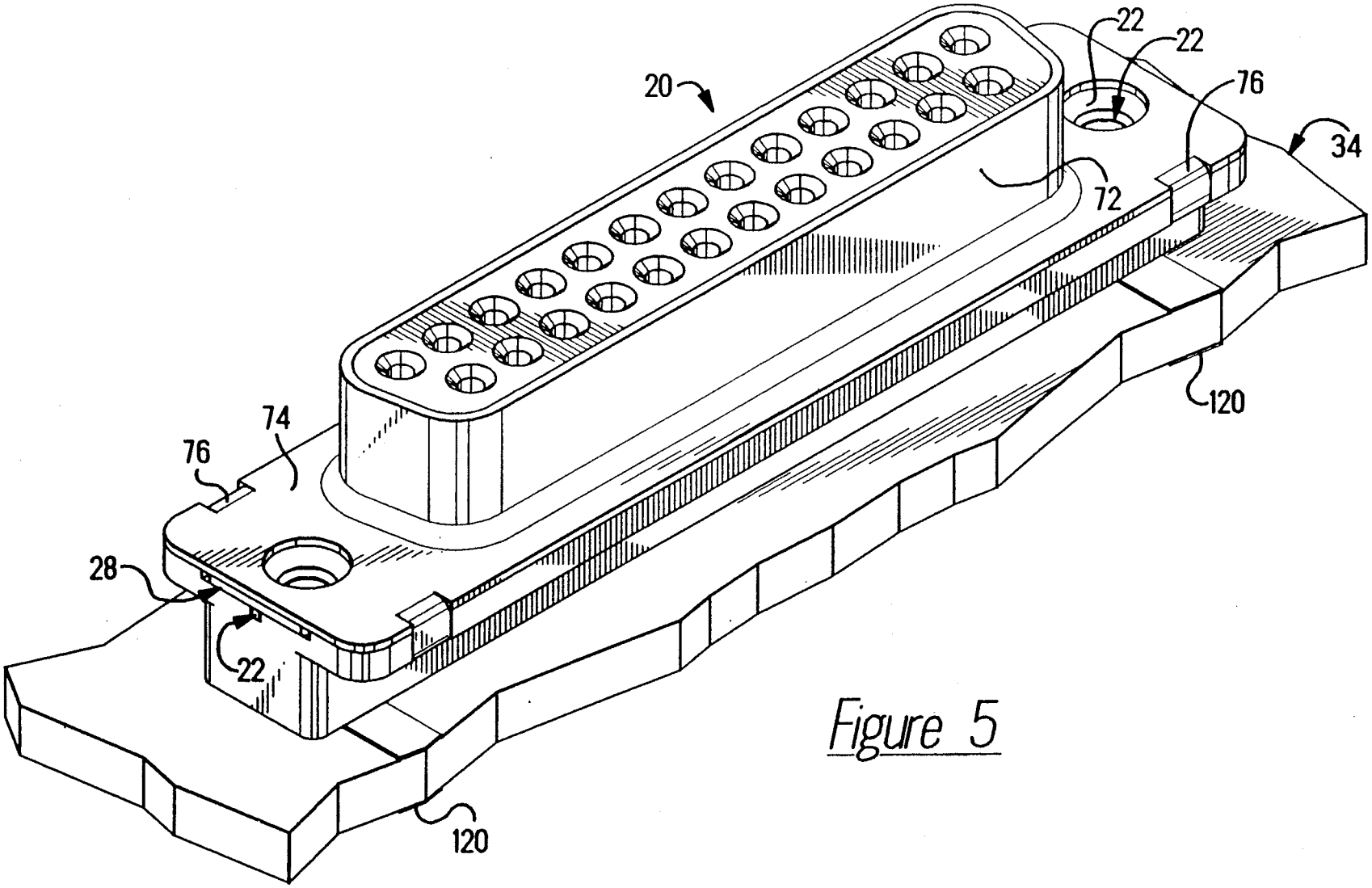
FIG. 5 is a perspective view of the connector shown in FIG. 1 assembled and mounted on a board.

FIG. 5 shows a connector 20 having two spaced apertures 54 with boardlocks 22 and inserts 28 therein mounted on circuit board 34.

Figure 6:
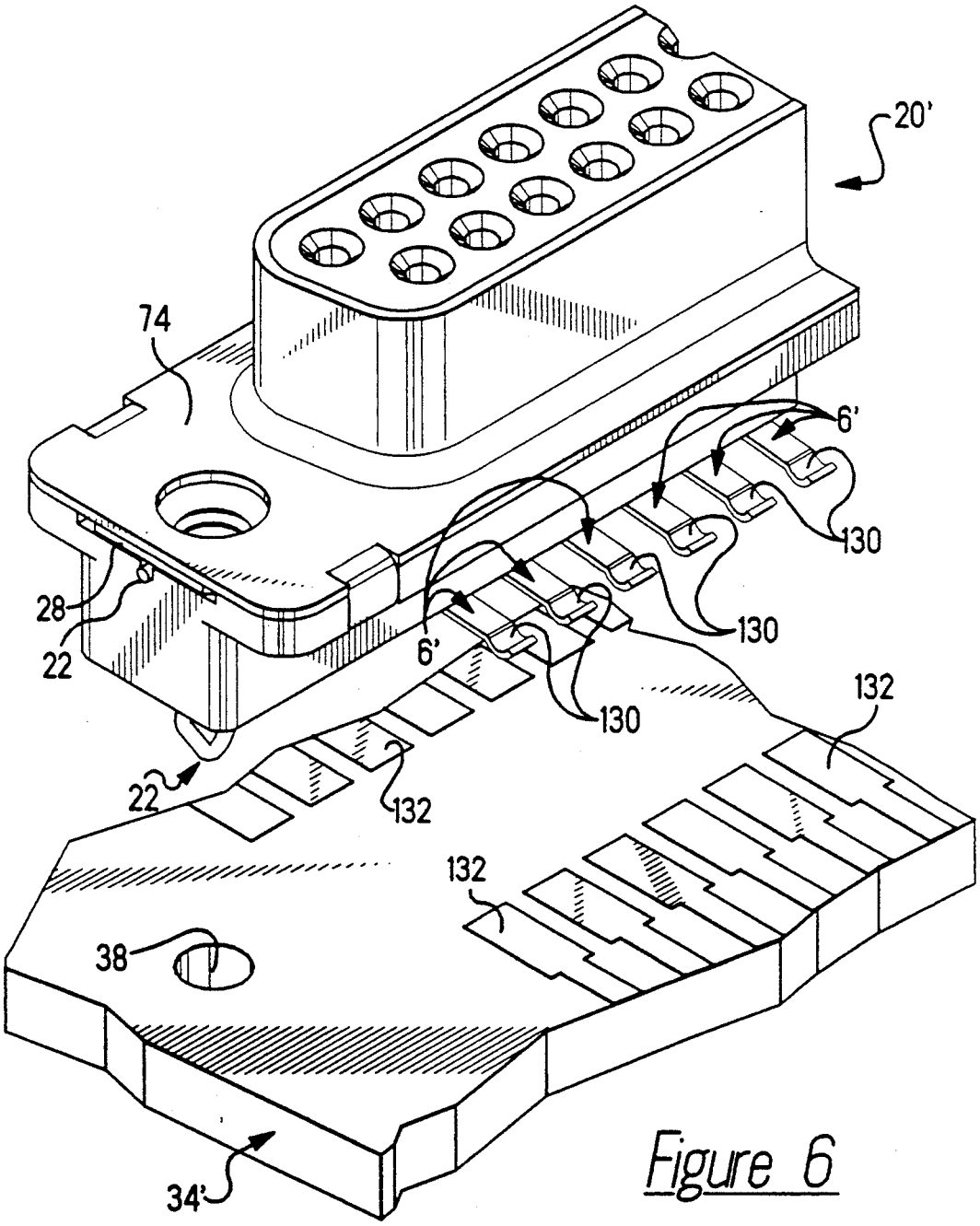
FIG. 6 is a perspective view of an alternate embodiment connector for surface mounting.

An alternate embodiment connector 20' having surface mount contacts 26' is shown in FIG. 6. For connector 20', contacts 26' each have a solder tail 130 receivable on land or solder pads 132 on board 34'. Solder pads 132 correspond in pitch and location to solder tails 130. In mounting connector 20' to board 34', connector 20' is positioned over board 34' with boardlocks 22 aligned with apertures 38 and with solder tails 130 aligned with corresponding pads 132. Connector 20' is then moved toward board 34 with boardlocks 22 passing into apertures 38 and solder tails 130 being received on respective ones of solder pads 132.

While the preferred embodiment has been described as having a wire formed boardlock 22 with retention portions 82 in engagement with the lower surface of flange 58, and flange 58 in engagement with the lower surface of shell 30 to establish electrical continuity between boardlock 22 and shell 30, any portion of insert 28 could be in engagement with any portion of boardlock 22 to provide electrical continuity between boardlock 22 and shell 30.

While the preferred embodiment has been disclosed as having insert 28 between boardlock 22 and shell 30, when insert 58 is omitted, recess 56 is not required and transverse slots 62 may be directly in surface 52 such that retention portions 82 are in direct engagement with and therefore electrically commoned with shell 30.

We claim:

1. An electrical connector, comprising:

a dielectric housing have contacts secured therein, said housing having a mounting flange having a mounting face, a top face and an aperture defining a wall extending therebetween, the top face having a transverse channel therein, the wall having a channel intersecting the transverse channel, the transverse channel and the channel in the wall being substantially perpendicular to each other;

an electrically conductive shell secured to the housing and surrounding at least a portion thereof; and a wire formed boardlock disposed in the aperture, the boardlock having a first portion within the aperture and a second portion extending beyond the mounting face for reception in a boardlock receiving hole in a circuit board, the first portion of the boardlock including a retention portion receivable in the transverse channel and an alignment portion receivable in the channel in the wall, the first portion electrically commoned with the shell, whereby a ground path is established between the shell and the boardlock through engagement between the shell and the boardlock.

2. An electrical connector as recited in claim 1, wherein the top face of the housing further comprises a recess of predetermined depth proximate the aperture, the transverse channel being a bottom surface of the recess; and an insert extending into the aperture, the insert having a flange receivable in the recess and a shank extending therebeyond further into the aperture, the flange engagable on one side with the shell and on the other side with the retention portion of the boardlock.

3. An electrical connector as recited in claim 2, further comprising an aperture in the shell aligned with the aperture in the housing, the insert further comprising threads on an inside surface of the shank.

4. An electrical connector, comprising:

a dielectric housing having contacts secured therein, said housing having a mounting flange having a mounting face, a top face and an aperture extending therebetween;

a boardlock disposed in the aperture, the boardlock having a first portion within the aperture and a second portion extending beyond the mounting face for reception in a boardlock receiving hole in a circuit board;

an insert extending into the aperture, the insert having a flange and an internally threaded shaft, the insert engaging the first portion of the boardlock; and an electrically conductive shell secured to the housing and surrounding at least a portion thereof, said shell engaging the insert, whereby a ground path is established between the shell and the boardlock through engagement between the shell and the insert thence the insert and the boardlock.

5. An electrical connector as recited in claim 4, wherein the boardlock is a wire formed boardlock.

6. An electrical connector as recited in claim 4, wherein the top face of the mounting flange further comprises a recess proximate the aperture to receive the insert flange.

7. An electrical connector as recited in claim 6, wherein the flange of the insert is thicker than the recess depth in the mounting flange, whereby a compressive engagement is achieved between the shell and the flange of the insert to assure electrical continuity therebetween.

8. An electrical connector, comprising:

a dielectric housing having contacts secured therein, said housing having a mounting flange having a mounting face, a top face and an aperture defining a wall extending therebetween;

an electrically conductive shell secured to the housing and surrounding at least a portion thereof; and a wire formed boardlock disposed in the aperture, the boardlock having a first portion within the aperture and a second portion extending beyond the mounting face for reception in a boardlock receiving hole in a circuit board, the first portion electrically commoned with the shell, whereby a ground path is established between the shell and the boardlock through engagement between the shell and the boardlock.

* * * * *